US009720365B2

(12) United States Patent
Sato

(10) Patent No.: US 9,720,365 B2
(45) Date of Patent: Aug. 1, 2017

(54) IMAGE FORMING DEVICE HAVING FEED TRAY AND RETAINING UNIT RETAINING PHOTOSENSITIVE DRUMS

(71) Applicant: Brother Kogyo Kabushiki Kaisha, Nagoya-shi, Aichi-ken (JP)

(72) Inventor: Shougo Sato, Seto (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/457,075

(22) Filed: Mar. 13, 2017

(65) Prior Publication Data

US 2017/0184995 A1 Jun. 29, 2017

Related U.S. Application Data

(63) Continuation of application No. 14/933,883, filed on Nov. 5, 2015, now Pat. No. 9,599,948, which is a (Continued)

(30) Foreign Application Priority Data

Feb. 10, 2011 (JP) ..... 2011-027517

(51) Int. Cl.
*G03G 15/00* (2006.01)
*G03G 21/16* (2006.01)
*G03G 21/18* (2006.01)

(52) U.S. Cl.
CPC ..... *G03G 15/6529* (2013.01); *G03G 15/6502* (2013.01); *G03G 15/6514* (2013.01); (Continued)

(58) Field of Classification Search
CPC ..... G03G 15/6502; G03G 15/6514; G03G 15/6529; G03G 15/6552; G03G 21/1619; (Continued)

(56) References Cited

U.S. PATENT DOCUMENTS 4,751,552 A 6/1988 Itoigawa
4,952,989 A 8/1990 Kawano et al.
(Continued)

FOREIGN PATENT DOCUMENTS

JP H05-42251 U 4/1975
JP 58-123836 U 8/1983
(Continued)

*Primary Examiner* — Hoang Ngo
(74) *Attorney, Agent, or Firm* — Banner & Witcoff, Ltd.

(57) ABSTRACT

An image forming device includes: a main casing; a retaining unit; a feed tray; and a pickup roller. The retaining unit retains a plurality of photosensitive drums juxtaposedly arrayed and spaced away from each other in an array direction. The retaining unit is movable in the array direction between a mounted position in which the retaining unit is mounted in the main casing and a pulled-out position in which the retaining unit is pulled out of the main casing. The feed tray is configured to accommodate a first transferred medium. The pickup roller is configured to pick up the first transferred medium accommodated in the feed tray. The pickup roller is arranged to overlap with the retaining unit in the array direction.

7 Claims, 8 Drawing Sheets

Related U.S. Application Data continuation of application No. 14/203,055, filed on Mar. 10, 2014, now Pat. No. 9,182,738, which is a continuation of application No. 13/361,385, filed on Jan. 30, 2012, now Pat. No. 8,712,282.

(52) U.S. Cl.
CPC ..... *G03G 15/6552* (2013.01); *G03G 21/1619* (2013.01); *G03G 21/1633* (2013.01); *G03G 21/1642* (2013.01); *G03G 21/1695* (2013.01); *G03G 21/1839* (2013.01); *G03G 21/1853* (2013.01)

(58) Field of Classification Search
CPC ..... G03G 21/1633; G03G 21/1642; G03G 21/1695; G03G 21/1839; G03G 21/1853; G03G 15/01; G03G 15/01; G03G 2221/1684; G03G 2221/1869
See application file for complete search history.

(56) References Cited

U.S. PATENT DOCUMENTS

| | | | | |
|---|---|---|---|---|
| 7,444,100 | B2 | 10/2008 | Sato | |
| 7,447,467 | B2 | 11/2008 | Kamimura et al. | |
| 7,769,319 | B2 | 8/2010 | Sato | |
| 8,000,628 | B2 | 8/2011 | Sato et al. | |
| 8,233,819 | B2 | 7/2012 | Kondo | |
| 8,320,797 | B2 | 11/2012 | Inomata et al. | |
| 2006/0115308 | A1 | 6/2006 | Hattori | |
| 2006/0140673 | A1* | 6/2006 | Kamimura | G03G 15/01 399/119 |
| 2006/0140694 | A1 | 6/2006 | Yano | |
| 2009/0226205 | A1 | 9/2009 | Sato et al. | |
| 2009/0317130 | A1* | 12/2009 | Ishikawa | G03G 15/0105 399/116 |
| 2009/0324283 | A1* | 12/2009 | Mushika | G03G 21/1619 399/119 |
| 2010/0074648 | A1 | 3/2010 | Kondo | |
| 2010/0322666 | A1 | 12/2010 | Inomata et al. | |

FOREIGN PATENT DOCUMENTS

| | | | |
|---|---|---|---|
| JP | 61-239256 | A | 10/1986 |
| JP | 62-186156 | U | 11/1987 |
| JP | 06-016253 | | 1/1994 |
| JP | 06-130763 | A | 5/1994 |
| JP | 2006-058913 | A | 3/2006 |
| JP | 2006-184552 | A | 7/2006 |
| JP | 2006-193300 | A | 7/2006 |
| JP | 2008-105791 | A | 5/2008 |
| JP | 2008-292804 | A | 12/2008 |
| JP | 2009-210937 | A | 9/2009 |
| JP | 2010-072588 | A | 4/2010 |
| JP | 2011-007828 | A | 1/2011 |

* cited by examiner

IMAGE FORMING DEVICE HAVING FEED TRAY AND RETAINING UNIT RETAINING PHOTOSENSITIVE DRUMS

CROSS REFERENCE TO RELATED APPLICATION

This application is a continuation of U.S. patent application Ser. No. 14/933,883, filed on Nov. 5, 2015, which is a continuation of U.S. patent application Ser. No. 14/203,055, filed on Mar. 10, 2014, now U.S. Pat. No. 9,182,738 B2, issued Nov. 10, 2015, which is a continuation of U.S. patent application Ser. No. 13/361,385, filed on Jan. 30, 2012, now U.S. Pat. No. 8,712,282 B2, issued Apr. 29, 2014, which claims priority from Japanese Patent Application No. 2011-027517 filed Feb. 10, 2011. The contents of the above noted applications are incorporated herein by reference in their entirety.

TECHNICAL FIELD

The present invention relates to an image forming device using an electrophotographic method.

BACKGROUND

One electrophotographic type color printer conventionally well known in the art is an intermediate transfer type color printer. One such intermediate transfer type color printer includes a plurality of process cartridges each having the photosensitive drum for one of four colors, a drawer for retaining the plurality of process cartridges, an endless belt that is disposed below the plurality of process cartridges and contacts the photosensitive drum of each process cartridge, a secondary transfer roller that contacts a rear portion of the endless belt, a sheet supply tray that is disposed below the endless belt, and a discharge tray that is formed on the top of the printer.

In this color printer, each sheet of paper accommodated in the sheet supply tray is conveyed upward from the sheet supply tray so as to pass through a position between the endless belt and the secondary transfer roller. Then, the sheet is discharged to the discharge tray so as to be conveyed frontward. In other words, the sheet accommodated in the sheet supply tray passes through a generally C-shaped conveying path (so-called C-path) to be discharged to the discharge tray.

Further, this image forming device is capable of so-called "front access", replacing each process cartridge by pulling the drawer frontward and setting the sheet of paper in the sheet supply tray by pulling the sheet supply tray frontward.

SUMMARY

With regard to the above-described color printer, proposal has been made that a manual feed path accessible from a front side is provided.

If such a manual feed path is provided in the color printer, a space for disposing a mechanism for the manual feed path is required at a position between the endless belt and the sheet supply tray. This may increase the size of the printer.

In view of the foregoing, it is an object of the present invention to provide a compact image forming device having a second conveying path accessible from a pulled-out position side of a retaining unit.

In order to attain the above and other objects, the present invention provides an image forming device including: a main casing; a retaining unit; a feed tray; and a pickup roller. The retaining unit retains a plurality of photosensitive drums juxtaposedly arrayed and spaced away from each other in an array direction. The retaining unit is movable in the array direction between a mounted position in which the retaining unit is mounted in the main casing and a pulled-out position in which the retaining unit is pulled out of the main casing. The feed tray is configured to accommodate a first transferred medium. The pickup roller is configured to pick up the first transferred medium accommodated in the feed tray. The pickup roller is arranged to overlap with the retaining unit in the array direction.

According to another aspect of the present invention, the present invention provides an image forming device including: a main casing; a retaining unit; a transfer belt; a transfer roller; and a feed tray. The retaining unit retains a plurality of photosensitive drums juxtaposedly arrayed and spaced away from each other in an array direction. The retaining unit is movable in the array direction between a mounted position in which the retaining unit is mounted in the main casing and a pulled-out position in which the retaining unit is pulled out of the main casing. The transfer belt is arranged in confrontation with the plurality of photosensitive drums to be transferred with developer supported on each photosensitive drum. The transfer belt has a downstream end portion in a mounting direction in which the retaining unit is moved from the pulled-out position to the mounted position. The transfer roller is disposed in confrontation with the downstream end portion to transfer the developer, which is transferred to the transfer belt, to a transferred medium. The feed tray includes a lift member and a plate. The lift member is configured to lift a first transferred medium. The plate is disposed above the lift member and configured to place thereon a second transferred medium which is different from the first transferred medium and which has been supplied into the main casing.

BRIEF DESCRIPTION OF THE DRAWINGS

The particular features and advantages of the invention as well as other objects will become apparent from the following description taken in connection with the accompanying drawings, in which.

DETAILED DESCRIPTION

Figure 1:
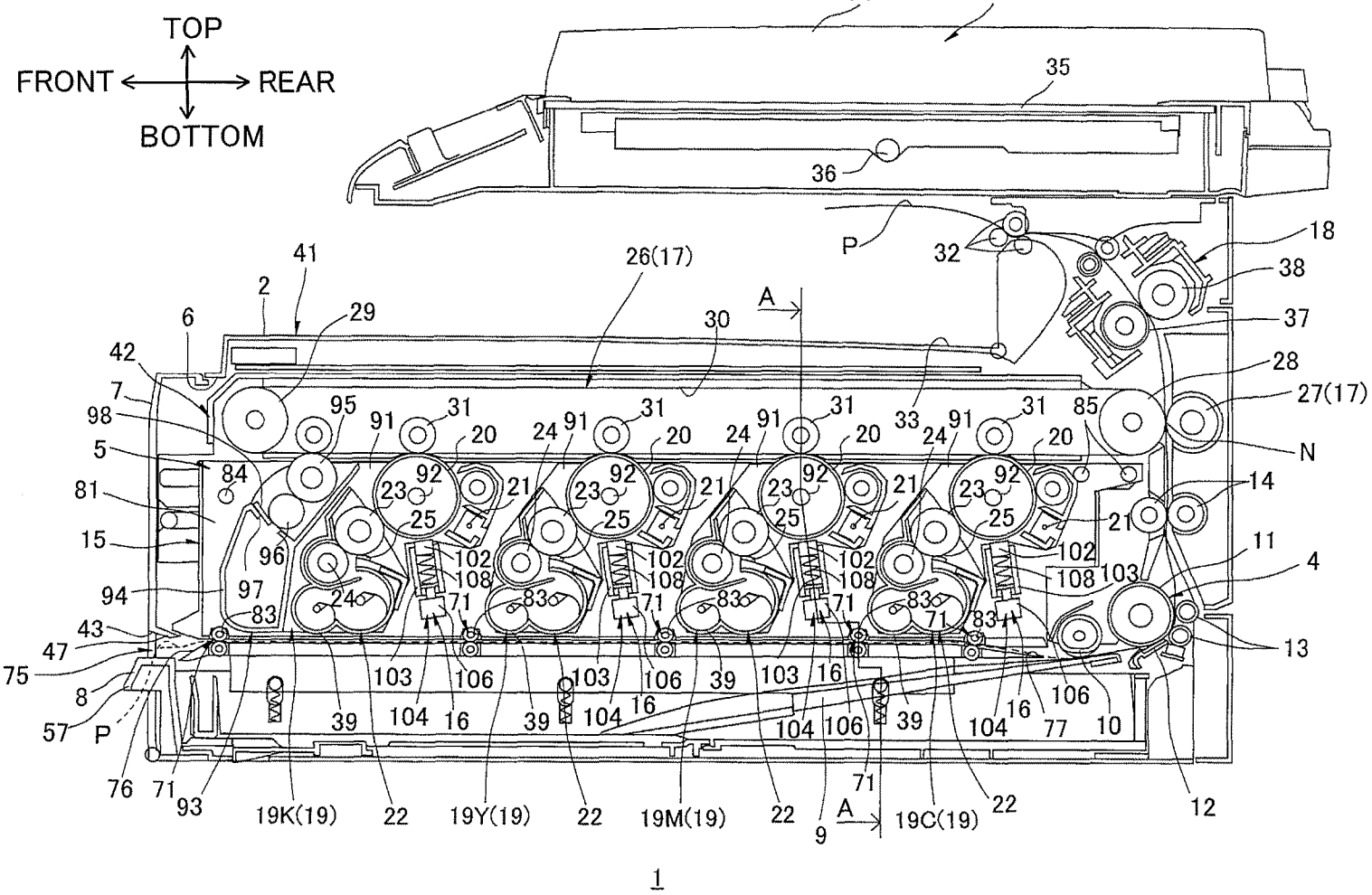
FIG. 1 is a cross-sectional view of a color printer as an image forming device according to a first embodiment of the present invention.

An image forming device according to a first embodiment of the present invention will be described while referring to FIGS. 1 to 5 wherein like parts and components are designated by the same reference numerals to avoid duplicating description.

1. Overall Structure of Color Printer

As shown in FIG. 1, the image forming device according to the first embodiment is a horizontal intermediate transfer type color printer 1.

The color printer 1 is a multifunction device that is integrally provided with a main casing 2 and a flatbed scanner 3 for reading image from original documents. The flatbed scanner 3 is disposed above the main casing 2.

Within the main casing 2, the color printer 1 is further provided with a sheet supply unit 4 and an image forming unit 5. The sheet supply unit 4 functions to supply a sheet of paper P to the image forming unit 5. The image forming unit 5 functions to form images on the sheet of paper P supplied from the sheet supply unit 4.

(1) Main Casing

The main casing 2 has a box shape that is substantially rectangular in a side view. The sheet supply unit 4 and the image forming unit 5 are mounted in the main casing 2. The main casing 2 has one side wall in which an opening 6 is formed. A front cover 7 is provided on the side wall so as to be pivotally movable about a lower end thereof between a closed position for closing the opening 6 and an open position for opening the opening 6.

The terms "upward", "downward", "upper", "lower", "above", "below", "beneath", "right", "left", "front", "rear" and the like will be used throughout the description assuming that the color printer 1 is disposed in an orientation in which it is intended to be used. In the following description, the side of the color printer 1 on which the front cover 7 is provided (left side in FIG. 1) will be referred to as the front side of the color printer 1, and a side opposite to the side (right side in FIG. 1) will be referred to as the rear side of the color printer 1. The top, bottom, left, and right sides of the color printer 1 in the following description will be based on the reference point of a user viewing the color printer 1 from the front side.

(2) Sheet Supply Unit

The sheet supply unit 4 includes a sheet supply tray 8 for accommodating sheets of paper P.

The sheet supply tray 8 is disposed at a bottom portion of the main casing 2. The sheet supply tray 8 is detachably mounted in the main casing 2. Further, the sheet supply tray 8 includes a lift member 9 for lifting a rear edge of the sheet P up and down.

The lift member 9 is formed in a generally rectangular plate shape extending in a frontward/rearward direction. The lift member 9 is disposed at a posterior half of a bottom surface of the sheet supply tray 8 and pivotally movable about a front edge thereof. Further, a rear edge of the lift member 9 is urged upward by an urging member (not shown) such as a coil spring.

The lift member 9 is in a slanted posture such that the lift member 9 slants upward toward the rear edge by an urging force of the urging member (not shown). When the lift member 9 is in the slanted posture, the rear edge of the sheet P is lifted upward toward a pickup roller 10 (described later) to be pinched between the lift member 9 and the pickup roller 10.

The sheet supply unit 4 includes the pickup roller 10, a sheet supply roller 11, a sheet supply pad 12, a pair of pinch rollers 13, and a pair of registration rollers 14. The pickup roller 10 is disposed above a rear end portion of the sheet supply tray 8, and opposite and above the rear edge of the lift member 9. The sheet supply roller 11 is disposed rearward of the pickup roller 10. The sheet supply pad 12 is disposed below and opposite the sheet supply roller 11. The pair of pinch rollers 13 opposes each other in a vertical direction. The pair of pinch rollers 13 is disposed rearward of the sheet supply roller 11 and contact the sheet supply roller 11. The pair of registration rollers 14 opposes each other in the frontward/rearward direction and disposed above the sheet supply roller 11.

The sheets P (indicated by a solid line shown in FIG. 1) accommodated in the sheet supply tray 8 are conveyed between the sheet supply roller 11 and the sheet supply pad 12 in association with rotation of the pickup roller 10, and separated sheet by sheet in association with rotation of the sheet supply roller 11. Then, in association with rotation of the sheet supply roller 11, the separated sheet P is conveyed toward the registration rollers 14 while passing between the sheet supply roller 11 and each pinch roller 13. In association with rotation of the registration rollers 14, the sheet P is conveyed to the image forming unit 5 (between an intermediate transfer belt 30 (described later) and a secondary transfer roller 27 (described later)) at a prescribed timing. This conveying path extending from the sheet supply tray 8 to the image forming unit 5 through the sheet supply roller 11, the pinch rollers 13, and the registration rollers 14 corresponds to a first conveying path.

(3) Image Forming Unit

The image forming unit 5 is disposed above the sheet supply unit 4. The image forming unit 5 includes a process unit 15, a transfer unit 17, and a fixing unit 18.

(3-1) Process Unit

The process unit 15 is disposed above and opposite the sheet supply tray 8 and also disposed frontward of the pickup roller 10 and the sheet supply roller 11 so as to be overlapped with the pickup roller 10 and the sheet supply roller 11 when projected in the frontward/rearward direction (a sliding direction or a juxtaposed direction). In other words, the process unit 15 is arranged to overlap with the pickup roller 10 and the sheet supply roller 11 in the frontward/rearward direction. The process unit 15 retains four process cartridges 19 corresponding to four colors (cyan, magenta, yellow, and black). Further, the process unit 15 is slidably movable in the frontward/rearward direction between a mounted position in which the process unit 15 is mounted in the main casing 2 and a pulled-out position in which the process unit 15 is pulled out of the main casing 2. That is, the process unit 15 is slidably mounted on the main casing 2 in the sliding direction.

Four process cartridges 19 are juxtaposedly arrayed with each other at regular intervals in the frontward/rearward direction. More specifically, a black process cartridge 19K, a yellow process cartridge 19Y, a magenta process cartridge 19M, and a cyan process cartridge 19C are aligned in this order from front to rear.

Further, each process cartridge 19 includes a photosensitive drum 20, a Scorotron charger 21, a developing unit 22, and an LED unit 16.

The photosensitive drum 20 is cylindrical in shape extending in a rightward/leftward direction (longitudinal direction) and oriented with its axis along the rightward/leftward direction.

The Scorotron charger 21 is disposed diagonally below and rearward of the corresponding photosensitive drum 20, and confronts but does not contact the corresponding photosensitive drum 20.

The developing unit 22 is disposed diagonally below and frontward of the corresponding photosensitive drum 20. The four developing units 22 are juxtaposedly arrayed with each other at regular intervals in the frontward/rearward direction. The developing unit 22 includes a developing roller 23.

The developing roller 23 is rotatably supported in an upper end of the corresponding developing unit 22. An upper rear edge of the developing roller 23 is exposed through an upper edge of the developing unit 22 and contacts the corresponding photosensitive drum 20 from below.

The developing unit 22 also includes a supply roller 24 for supplying toner to the corresponding developing roller 23 and a thickness-regulating blade 25 for regulating the thickness of the toner supplied to the developing roller 23. Further, the developing unit 22 includes a toner accommodating section 39 for accommodating toner as developer for a corresponding color therein. The toner accommodating section 39 is disposed below the supply roller 24. The toner accommodating section 39 is formed in a configuration such that two cylindrical bodies extending in the rightward/leftward direction are connected to each other in the frontward/rearward direction.

The LED unit 16 is disposed rearward of the corresponding developing unit 22. Further, the LED unit 16 is disposed below the corresponding photosensitive drum 20 and confronts the corresponding photosensitive drum 20. The LED unit 16 exposes a surface of the corresponding photosensitive drum 20 based on prescribed image data.

(3-2) Transfer Unit

The transfer unit 17 includes a belt unit 26 and the secondary transfer roller 27.

The belt unit 26 is disposed above the process unit 15 so as to confront each photosensitive drum 20 from above and oriented in the frontward/rearward direction. In other words, the belt unit 26 opposes the process unit 15 in the vertical direction.

The belt unit 26 includes a drive roller 28, a driven roller 29, the intermediate transfer belt 30, and four primary transfer rollers 31.

The drive roller 28 and the driven roller 29 are arranged in confrontation with and spaced apart from each other in the frontward/rearward direction.

The intermediate transfer belt 30 is stretched around the drive roller 28 and the driven roller 29, with a lower portion of the intermediate transfer belt 30 contacting each of the photosensitive drums 20. The intermediate transfer belt 30 circulates so that the lower portion of the intermediate transfer belt 30 in contact with the photosensitive drums 20 moves rearward.

Each primary transfer roller 31 is disposed in confrontation with the corresponding photosensitive drum 20, interposing the lower portion of the intermediate transfer belt 30 between the primary transfer roller 31 and the photosensitive drum 20.

The secondary transfer roller 27 is disposed rearward of the belt unit 26. Further, the secondary transfer roller 27 is disposed in confrontation with the drive roller 28 of the belt unit 26, interposing the intermediate transfer belt 30 between the secondary transfer roller 27 and the drive roller 28.

(3-3) Fixing Unit

The fixing unit 18 is disposed above the secondary transfer roller 27. The fixing unit 18 includes a heating roller 37 and a pressure roller 38 disposed in confrontation with the heating roller 37.

(3-4) Image Forming Operations (3-4-1) Developing Operation

The toner accommodated in the toner accommodating section 39 of the developing unit 22 is supplied to the supply roller 24, and then to the developing roller 23.

As the developing roller 23 rotates, the thickness-regulating blade 25 regulates the toner carried on the surface of the developing roller 23 to a prescribed thickness, so that the developing roller 23 carries a uniform thin layer of toner thereon. The toner supplied to the developing roller 23 is positively tribocharged between the thickness-regulating blade 25 and the developing roller 23.

In the meantime, the Scorotron charger 21 applies uniform charge of positive polarity to a surface of the corresponding photosensitive drum 20 as the photosensitive drum 20 rotates. Subsequently, the LED unit 16 exposes the surface of the corresponding photosensitive drum 20 based on image data. An electrostatic latent image corresponding to an image to be formed on the sheet P is formed on the surface of the photosensitive drum 20.

As the photosensitive drum 20 continues to rotate, the positively charged toner carried on the surface of the developing roller 23 is supplied to the electrostatic latent image formed on the surface of the photosensitive drum 20, thereby developing the electrostatic latent image into a visible toner image through reverse development. Thus, the toner image is formed on the surface of the photosensitive drum 20.

(3-4-2) Transfer and Fixing Operations

The toner image formed on the surface of each photosensitive drum 20 through reverse development is primary-transferred onto the lower portion of the intermediate transfer belt 30 conveyed rearward from front, thereby forming a color image on the intermediate transfer belt 30.

The color image formed on the intermediate transfer belt 30 is secondary-transferred onto the sheet P supplied from the sheet supply unit 4 while the intermediate transfer belt 30 passes through a position N where the intermediate transfer belt 30 confronts the secondary transfer roller 27.

The color image transferred onto the sheet P is thermally fixed to the sheet P by heat and pressure in the fixing unit 18, as the sheet P passes between the heating roller 37 and the pressure roller 38.

(4) Discharge

After the color image has been fixed to the sheet P in the fixing unit 18, the sheet P is discharged by discharge rollers 32 onto a discharge tray 33 formed on a top surface of the main casing 2.

(5) Flatbed Scanner

The flatbed scanner 3 is disposed above the discharge tray 33. The flatbed scanner 3 includes a restraining cover 34, a glass plate 35, and a CCD sensor 36. After an original document is placed between the restraining cover 34 and the glass plate 35, the CCD sensor 36 is slidingly moved to read image data from the original document.

Based on the image data read from the original document, an image is formed on the sheet P in the image forming unit 5 as described above.

2. Main Casing

The main casing 2 includes an outer casing 41 and an inner casing 42

Figure 2:
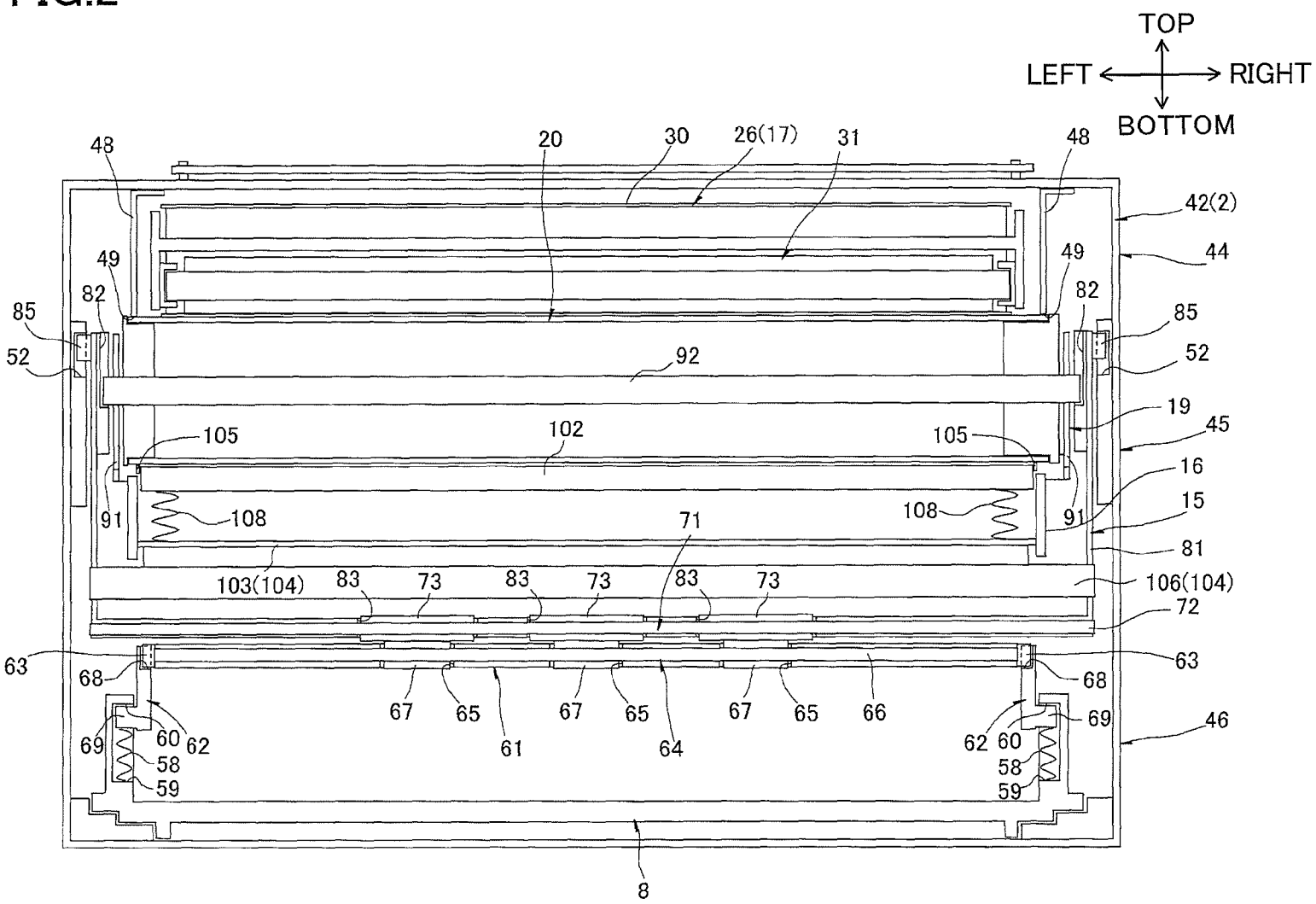
FIG. 2 is a cross-sectional view of the color printer taken along the line A-A in FIG. 1.

(FIG. 2). The outer casing 41 defines an outer shell of the color printer 1. The inner casing 42 is provided inside the outer casing 41.

(1) Details of Outer Casing

The outer casing 41 is formed in a generally box-shape. The outer casing 41 has a front wall on which the front cover 7 is provided.

The front cover 7 has a lower end that is pivotally movably connected to a bottom wall of the outer casing 41. An opening 43 is formed in a lower portion of the front cover 7. When the front cover 7 is in the closed position, the sheet supply tray 8 is inserted into or removed from the main casing 2 through the opening 43.

Further, the front cover 7 includes a manual insertion guide 47. The manual insertion guide 47 extends diagonally below and rearward from an upper edge of the opening 43 toward a position between a bottom wall of the process unit 15 and a sheet conveying member 61 (FIG. 2) of the sheet supply tray 8.

(2) Details of Inner Casing

As shown in FIGS. 1 and 2, the inner casing 42 is of a hollow rectangular cuboid configuration and elongated in the frontward/rearward direction. The inner casing 42 has a vertical length and a lateral (right to left) length such that the process unit 15, the belt unit 26, and the sheet supply tray 8 can be accommodated therein. The inner casing 42 is accommodated in the outer casing 41. The top, right, and left walls of the inner casing 42 are spaced apart from those of the outer casing 41.

The inner casing 42 includes a belt accommodating section 44 in which the belt unit 26 is accommodated, a process unit supporting section 45 for supporting the process unit 15, and a tray accommodating section 46 in which the sheet supply tray 8 is accommodated.

(2-1) Belt Accommodating Section

The belt accommodating section 44 is disposed at an upper portion of the inner casing 42. The belt accommodating section 44 includes a pair of right and left drum positioning members 48 for positioning each photosensitive drum 20 with respect to the belt unit 26.

Each of the pair of drum positioning members 48 is formed in a generally plate shape extending in the frontward/rearward direction. The pair of drum positioning members 48 is arranged in confrontation with each photosensitive drum 20 at a position outside of a sheet contacting region of each photosensitive drum 20 in the rightward/leftward direction. (Here, the sheet contacting region represents a region of the photosensitive drum 20 that the sheet P contacts.) The pair of drum positioning members 48 is also arranged spaced apart from each other in the rightward/leftward direction, interposing the belt unit 26 therebetween. An upper portion of each drum positioning member 48 is fixed to the top wall of the inner casing 42.

Figure 4:
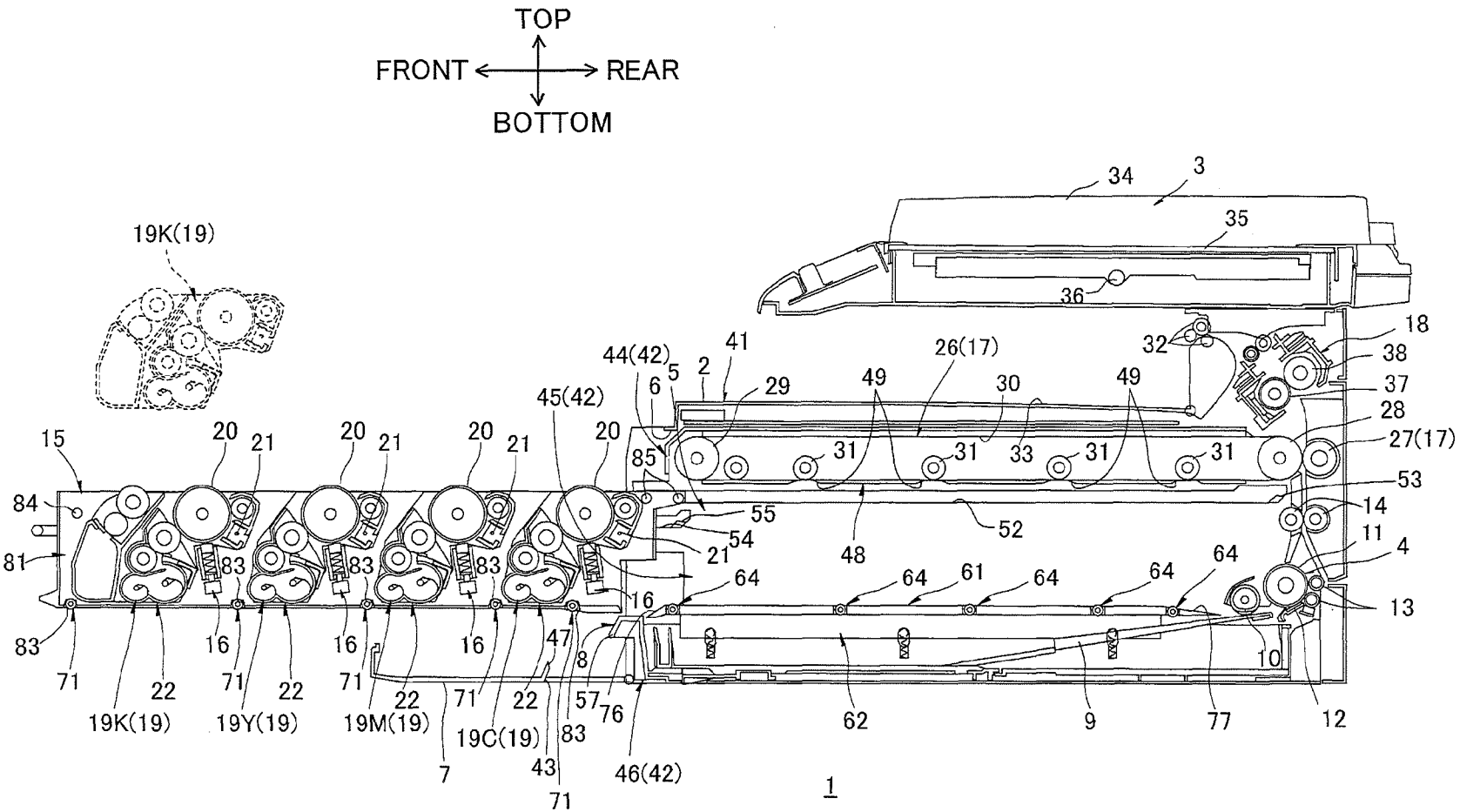
FIG. 4 is an explanatory view illustrating an insertion/removal process for a process cartridge of the color printer according to the first embodiment of the present invention.

As shown in FIG. 4, each drum positioning member 48 has a lower portion in which four drum positioning recesses 49 corresponding to the four photosensitive drums 20 are formed.

Each drum positioning recess 49 is a substantially U-shaped notch opened downward. More specifically, the drum positioning recess 49 is depressed upward from a lower edge of the drum positioning member 48. The four drum positioning recesses 49 are juxtaposedly arrayed with and spaced apart from each other in the frontward/rearward direction. Upper portions of right and left ends of the photosensitive drum 20 are retained in the drum positioning recesses 49 formed in the right and left drum positioning members 48.

(2-2) Process Unit Supporting Section

As shown in FIG. 2, the process unit supporting section 45 is disposed immediately below the belt accommodating section 44 at a substantially vertical center of the inner casing 42. The process unit supporting section 45 has right and left side walls, each formed with a first guide groove 52 and a second guide groove 54 (FIG. 4). The first guide groove 52 serves to guide a rear portion of the process unit 15. The second guide groove 54 serves to guide a front portion of the process unit 15.

The first guide groove 52 has a height (vertical length) allowing a pair of rear rollers 85 (described later) of the process unit 15 to be retained therein. The first guide groove 52 is formed in the process unit supporting section 45 across substantially the entire length in the frontward/rearward direction and extends linearly in the frontward/rearward direction. Further, the first guide groove 52 is formed such that a rear portion of the first guide groove 52 has a height (vertical length) greater than a remaining portion thereof and an interior space of the rear portion is expanded upward. A leaf spring 53 (FIG. 4) is provided in the rear portion of the first guide groove 52 so as to curve in an arcuate shape with its convex side facing a top surface of the first guide groove 52.

The leaf spring 53 is a curved metal plate extending in the frontward/rearward direction. The leaf spring plate 53 has a front end fixed to a bottom surface of the first guide groove 52. More specifically, the leaf spring plate 53 extends diagonally above and rearward from the front end, then bends rearward and extends in the frontward/rearward direction.

The second guide groove 54 is positioned below a front portion of the first guide groove 52. The second guide groove 54 has a height (vertical length) allowing a front roller 84 of the process unit 15 to be retained therein. The second guide groove 54 extends linearly in the frontward/rearward direction. Further, the second guide groove 54 is formed such that a rear portion of the second guide groove 54 has a height (vertical length) greater than a remaining portion thereof and an interior space of the rear portion is expanded upward. A leaf spring 55 (FIG. 4) is provided in the rear portion of the second guide groove 54 so as to curve in an arcuate shape with its convex side facing a top surface of the second guide recess 54.

The leaf spring 55 has a shape that is the same as the leaf spring plate 53 provided in the first guide groove 52. The leaf spring plate 55 has a front end fixed to a bottom surface of the second guide groove 54.

(2-3) Tray Accommodating Section

The tray accommodating section 46 is disposed at a lower portion of the inner casing 42 and immediate below the process unit supporting section 45.

3. Process Unit (1) Process Frame

The process unit 15 includes a process frame 81 for integrally retaining the process cartridges 19 and the LED units 16 therein.

The process frame 81 is formed in a substantially rectangular box shape with an open top. The process frame 81 has right and left side walls each formed with four cartridge guide recesses 82 (FIG. 2) and a bottom wall formed with five sets of three first roller retaining openings 83. Each of the four sets of the right and left cartridge guide recesses 82 serve to guide removal of the process cartridge 19 from and insertion of the process cartridge 19 into the process unit 15.

Each first roller retaining opening 83 is adapted to retain a first roller member 73 (described later) of a first conveying member 71 (described later).

Each cartridge guide recess 82 is formed on an inner surface of each right and left side walls of the process frame 81 and extends in the vertical direction. Each of the right and left cartridge guide recesses 82 is a depressed portion having a width capable of retaining a rotation shaft 92 (described later) of the photosensitive drum 20.

Each first roller retaining openings 83 is formed in a rectangular shape in a side view and penetrates the bottom wall of the process frame 81 in the vertical direction. The three first roller retaining openings 83 in each set are arrayed in the rightward/leftward direction at regular intervals one another. The five sets of the three first roller retaining openings 83 are juxtaposedly arrayed with each other in the frontward/rearward direction. More specifically, the foremost set of the three first roller retaining openings 83 is disposed at the front portion of the process unit 15, the rearmost set of the three first roller retaining openings 83 is disposed at the rear portion of the process unit 15, and the remaining three sets of the three first roller retaining openings 83 are respectively provided at positions between each process cartridge 19. Each first roller retaining opening 83 has a length in the frontward/rearward direction greater than an outer diameter of the first roller member 73 (described later) and a length in the rightward/leftward direction greater than that of the first roller member 73 (described later).

Each of the right and left side walls of the process frame 81 is provided with the front roller 84 and the pair of rear rollers 85. The front roller 84 disposed at the right side wall is rotatably provided in a front portion of the right side wall and protrudes outward from the right side wall in the rightward/leftward direction. Likewise, the front roller 84 disposed at the left side wall is rotatably provided in a front portion of the left side wall and protrudes outward from the left side wall in the rightward/leftward direction. The pair of rear rollers 85 disposed at the right side wall is rotatably provided in a rear portion of the right side wall and protrudes outward from the right side wall in the rightward/leftward direction. Likewise, the pair of rear rollers 85 disposed at the left side wall is rotatably provided in a rear portion of the left side wall and protrudes outward from the left side wall in the rightward/leftward direction.

(2) Process Cartridge

Each process cartridge 19 has a pair of side plates 91 arranged in confrontation with and spaced apart from each other in the rightward/leftward direction. The photosensitive drum 20, the Scorotron charger 21, and the developing unit 22 are disposed between the side plates 91.

The rotation shaft 92 of the photosensitive drum 20 has right and left ends penetrating the right and left side plates 91 respectively and rotatably supported to the side plates 91. Further, the right and left ends of the rotation shaft 92 protrude outward in the rightward/leftward direction from outer surfaces of the side plates 91.

The black process cartridge 19K integrally retains a belt cleaning unit 93. The belt cleaning unit 93 is disposed frontward of the developing unit 22 of the black process cartridge 19K.

The belt cleaning unit 93 includes a waste toner retaining section 94, a scraping roller 96, a scraping blade 98, and a belt cleaning roller 95.

The waste toner retaining section 94 is formed in a generally box-shape having a top opening 97.

The scraping roller 96 is disposed above the opening 97 of the waste toner retaining section 94. The scraping roller 96 is arranged in confrontation with the opening 97.

The scraping blade 98 is formed in a generally plate shape extending in the frontward/rearward direction. The scraping blade 98 has a front end (base end) that is fixed to the waste toner retaining section 94 at a front periphery of the opening 97 and a rear end (free end) that contacts the scraping roller 96 from below.

The belt cleaning roller 95 is rotatably supported to an upper portion of the belt cleaning unit 93 so as to contact the scraping roller 96 from above.

The belt cleaning unit 93 is arranged such that the belt cleaning roller 95 contacts the lower portion of the intermediate transfer belt 30 from below. The belt cleaning unit 93 serves to clean waste toner deposited on the surface of the intermediate transfer belt 30 by the belt cleaning roller 95. After the waste toner carried on the belt cleaning roller 95 is supplied to the scraping roller 96, the waste toner carried on the scraping roller 96 is scraped off with the scraping blade 98. Hence, the waste toner is retained in the waste toner retaining section 94.

(3) LED Unit

Each LED unit 16 includes an LED array supporting member 104 provided between the right and left side walls of the process frame 81 and an LED array 102 supported to the LED array supporting member 104.

The LED array supporting member 104 includes a support beam 106 and an LED array accommodating member 103.

The support beam 106 is formed in a generally quadrangular prism shape extending in the rightward/leftward direction. The support beam 106 is disposed between the right and left side walls of the process frame 81.

The LED array accommodating member 103 is formed in a generally rectangular frame shape having a bottom wall and elongated in the rightward/leftward direction. The bottom wall of the LED array accommodating member 103 is connected to the support beam 106. The LED array accommodating member 103 has an internal dimension in the frontward/rearward direction almost the same as (slightly greater than) an external dimension of the LED array 102 in the frontward/rearward direction. Further, the LED array accommodating member 103 has an internal dimension in the rightward/leftward direction almost the same as (slightly greater than) an external dimension of the LED array 102 in the rightward/leftward direction.

The LED array 102 is formed in a generally quadrangular prism shape and elongated in the rightward/leftward direction. The LED array 102 integrally holds a plurality of LEDs arrayed in the rightward/leftward direction therein. The LED array 102 has a length in the rightward/leftward direction smaller than that of the photosensitive drum 20 but greater than that of the sheet contacting region.

The LED array 102 has right and left ends, each having an LED positioning member 105 (FIG. 2) for positioning the LED array 102 relative to the corresponding photosensitive drum 20.

Each LED positioning member 105 is formed in a plate shape that is substantially rectangular in a side view. The LED positioning members 105 are arranged to slightly protrude upward from the respective right and left edges of the LED array 102. The LED positioning members 105 contact the photosensitive drum 20 from below, thereby positioning the LED array 102 relative to the photosensitive drum 20 such that the LED array 102 is in confrontation with the photosensitive drum 20 at an interval corresponding to the protruding length of the LED positioning members 105.

It should be noted that the LED positioning member 105 is not limited to the rectangular plate shape. For example, the LED positioning member 105 may be a generally disk shaped roller.

The LED array 102 is movable relative to the LED array accommodating member 103. The LED array 102 has a lower portion that is accommodated in an upper portion of the LED array accommodating member 103. The LED array 102 is resiliently supported to the bottom wall of the LED array accommodating member 103 by a pair of right and left compression springs 108.

More specifically, the right compression spring 108 has one end connected to a right end of the bottom wall of the LED array accommodating member 103 and another end connected to a right end of the LED array 102. Likewise, the left compression spring 108 has one end connected to a left end of the bottom wall of the LED array accommodating member 103 and another end connected to a left end of the LED array 102. With this configuration, the LED array 102 is resiliently supported relative to the bottom wall of the LED array accommodating member 103 via the compression springs 108.

(4) First Conveying Member

The process unit 15 includes five first conveying members 71. The five first conveying members 71 are disposed at the bottom wall of the process frame 81. The five first conveying members 71 are juxtaposedly arrayed with each other in the frontward/rearward direction. More specifically, the foremost first conveying member 71 is disposed at the front portion of the process unit 15, the rearmost first conveying member 71 is disposed at the rear portion of the process unit 15, and the remaining three of the first conveying members 71 are respectively provided at positions between each process cartridge 19 in the rightward/leftward direction (between each process cartridge 19 when projected in the vertical direction).

Each first conveying member 71 includes a first roller shaft 72 and three first roller members 73. Each first roller member 73 is fixed to the first roller shaft 72 and non-rotatable relative to the first roller shaft 72.

The first roller shaft 72 is formed in a generally columnar shape and elongated in the rightward/leftward direction. Further, the first roller shaft 72 has a length in the rightward/leftward direction greater than that of the process unit 15.

Each first roller member 73 has a hollow cylindrical configuration allowing the first roller shaft 72 to penetrate therethrough and is elongated in the rightward/leftward direction. The first roller member 73 has an outer diameter greater than a thickness (i.e. a vertical length) of the bottom wall of the process frame 81 and an inner diameter almost the same as an outer diameter of the first roller shaft 72.

Each first conveying member 71 is provided at the bottom wall of the process frame 81 such that each first roller member 73 is rotatably retained in the corresponding first roller retaining opening 83 formed in the process frame 81 and the first roller shaft 72 is rotatably embedded in the bottom wall of the process frame 81.

A drive force transmission mechanism (not shown) provided in the main casing 2 inputs a drive force into each first conveying member 71.

4. Sheet Supply Tray

Figure 3:
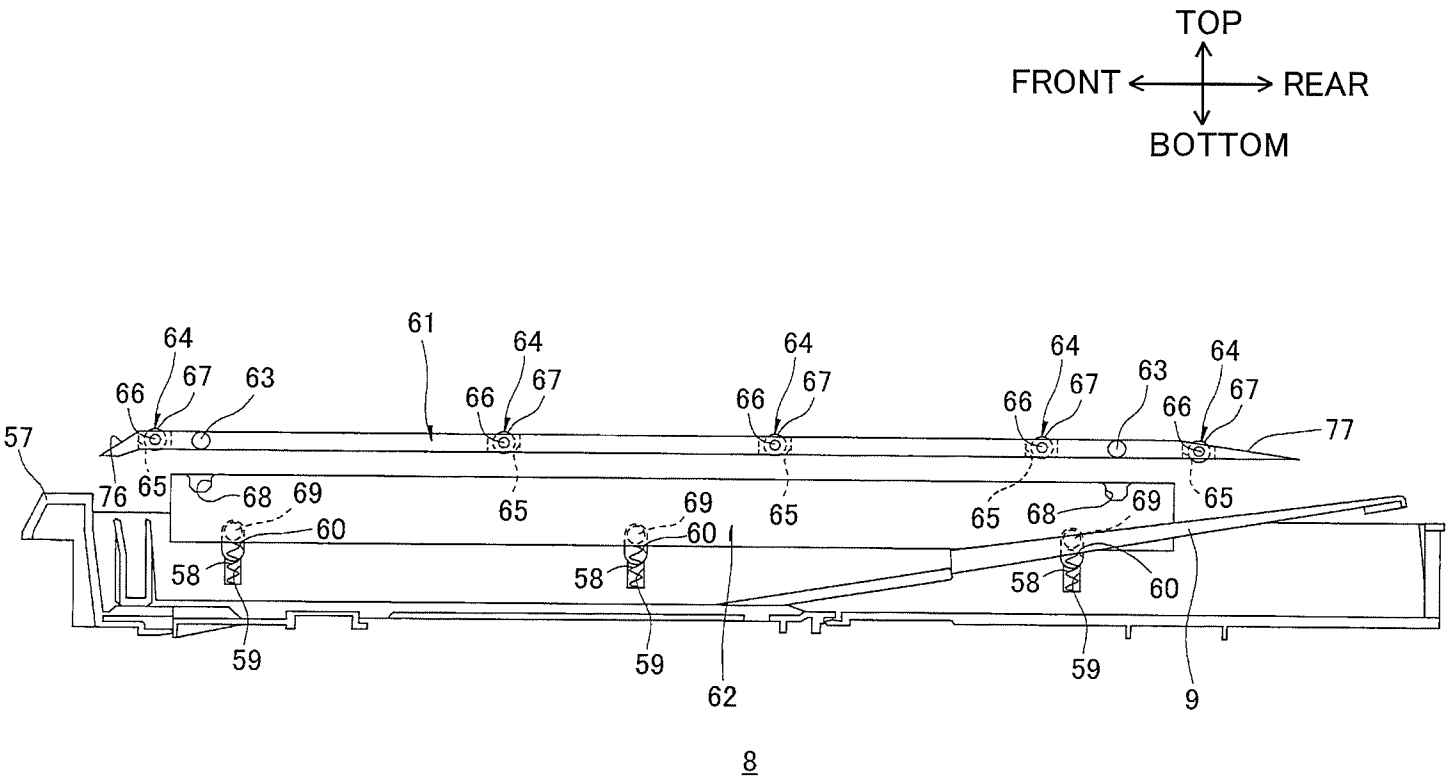
FIG. 3 is an exploded cross-sectional view of a sheet supply tray of the color printer according to the first embodiment of the present invention.

As shown in FIGS. 1 and 3, the sheet supply tray 8 is formed in a substantially rectangular box shape with an open top. The sheet supply tray 8 is detachably accommodated in the tray accommodating section 46 of the inner casing 42. The sheet supply tray 8 has a front wall arranged in confrontation with and spaced apart from the manual insertion guide 47 of the front cover 7 in the vertical direction. The front wall of the sheet supply tray 8 has a vertical length smaller than that of the opening 43.

The front wall of the sheet supply tray 8 has an upper portion in which a handle 57 is provided. The handle 57 is formed in a generally U-shape in cross-section having a bottom open.

The handle 57 extends forward from an upper edge of the front wall of the sheet supply tray 8, and then bends diagonally below and forward at a front edge of the extending portion of the handle 57. With this configuration, the handle 57 has an upper surface extending in the frontward/rearward direction.

A gap between the upper surface of the handle 57 and the manual insertion guide 47 of the front cover 7 defines a manual insertion opening 75 into which a sheet P other than the sheet P accommodated in the sheet supply tray 8 is inserted.

The sheet supply tray 8 includes a sheet conveying member 61 and a pair of right and left support members 62 (FIG. 2) for supporting the sheet conveying member 61.

The sheet conveying member 61 is formed in a generally plate shape elongated in the frontward/rearward direction. The sheet conveying member 61 is detachable from or attachable to the pair of support members 62. The sheet conveying member 61 has a length in the rightward/leftward direction almost the same as an internal dimension of the sheet supply tray 8 in the rightward/leftward direction (FIG. 2).

The sheet conveying member 61 has a front portion sloping diagonally below and frontward. The front portion of the sheet conveying member 61 confronts the upper portion of the front wall of the sheet supply tray 8 from rear. The front portion of the sheet conveying member 61 has an upper surface serving as a front guide surface 76 extending diagonally above and rearward from front.

The sheet conveying member 61 has a rear portion formed in a generally wedge shape in a side view having an apex directed rearward. The rear portion of the sheet conveying member 61 is arranged in confrontation with the rear edge of the lift member 9 from front. Further, the rear portion of the sheet conveying member 61 has an upper surface serving as a rear guide surface 77 extending diagonally below and rearward from front.

Further, the sheet conveying member 61 is formed with five sets of three second roller retaining openings 65. Further, the sheet conveying member 61 includes two sets of a pair of right and left supported bosses 63 supported by the pair of support members 62 and five second conveying members 64 for conveying the sheet P.

Each second roller retaining opening 65 is formed in a square shape in a side view and penetrates the sheet conveying member 61 in the vertical direction. When the process unit 15 and the sheet supply tray 8 is mounted in the main casing 2, each second roller retaining opening 65 is arranged so as to confront the corresponding first roller retaining opening 83 formed in the process frame 81 in the vertical direction. Each second roller retaining opening 65 has a length in the frontward/rearward direction greater than an outer diameter of a second roller member 67 (described later). Further, each second roller retaining opening 65 has a length in the rightward/leftward direction greater than that of the second roller member 67 (described later).

The sheet conveying member 61 has right and left side surfaces on which the right and left supported bosses 63 are respectively provided. Each right supported boss 63 is formed in a generally cylindrical shape protruding outward from the right side surface of the sheet conveying member 61 in the rightward/leftward direction. One of the right supported bosses 63 is disposed at the front portion of the sheet conveying member 61 and a remaining one of the right supported bosses 63 is disposed at the rear portion of the sheet conveying member 61. Likewise, each left supported boss 63 is formed in a generally cylindrical shape protruding outward from the left side surface of the sheet conveying member 61 in the rightward/leftward direction. One of the left supported bosses 63 is disposed at the front portion of the sheet conveying member 61 and a remaining one of the left supported bosses 63 is disposed at the rear portion of the sheet conveying member 61.

Each second conveying member 64 includes a second roller shaft 66 and three second roller members 67. Each second roller member 67 is fixed to the second roller shaft 66 and non-rotatable relative to the second roller shaft 66.

The second roller shaft 66 is formed in a generally columnar shape and elongated in the rightward/leftward direction. Further, the second roller shaft 66 has a length in the rightward/leftward direction almost the same as that of the sheet conveying member 61.

Each second roller member 67 has a hollow cylindrical configuration allowing the second roller shaft 66 to penetrate therethrough and is elongated in the rightward/leftward direction. The second roller member 67 has an outer diameter greater than a thickness (i.e. vertical length) of the sheet conveying member 61 and an inner diameter almost the same as an outer diameter of the second roller shaft 66. Further, the second roller member 67 has a length in the rightward/leftward direction smaller than that of the first roller member 73.

Each second conveying member 64 is provided in the sheet conveying member 61 such that each second roller member 67 is rotatably retained in the corresponding second roller retaining opening 65 formed in the sheet conveying member 61 and the second roller shaft 66 is rotatably embedded in the sheet conveying member 61.

Each of the right and left support members 62 is formed in a generally plate shape and elongated in the frontward/rearward direction. The right support member 62 has front and rear portions, each formed with a support recess (right support recess) 68 for receiving the right supported boss 63 of the sheet conveying member 61. Further, the right support member 62 has a lower portion provided with three insertion bosses (right insertion bosses) 69. Likewise, the left support member 62 has front and rear portions, each formed with a support recess (left support recess) 68 for receiving the left support boss 63 of the sheet conveying member 61. Further, the left support member 62 has a lower portion provided with three insertion bosses (left insertion bosses) 69.

Each right support recess 68 is a generally U-shaped recess formed in an inner surface of the right support member 62 and depressed downward from an upper edge of the right support member 62. Likewise, each left support recess 68 is a generally U-shaped recess formed in an inner surface of the left support member 62 and depressed downward from an upper edge of the left support member 62.

The three right insertion bosses 69 are respectively disposed at front, center, and rear portions of the right support member 62 in the frontward/rearward direction. Each right insertion boss 69 is formed in a generally cylindrical shape protruding outward (rightward) from an outer surface of the right support member 62 in the rightward/leftward direction.

Likewise, the three left insertion bosses 69 are respectively disposed at front, center, and rear portions of the left support member 62 in the frontward/rearward direction. Each left insertion boss 69 is formed in a generally cylindrical shape protruding outward (leftward) from an outer surface of the left support member 62 in the rightward/leftward direction.

Further, the sheet supply tray 8 has a pair of right and left side walls, each formed with three spring accommodating portions 59 and three insertion holes 60 at positions corresponding to the three insertion bosses 69 of the respective right and left support members 62.

Each spring accommodating portion 59 is formed in an inner surface of each right and left side wall of the sheet supply tray 8. The spring accommodating portion 59 has a rectangular shape in a side view and is elongated in the vertical direction.

A compression spring 58 is accommodated in each spring accommodating portion 59. The compression spring 58 has one end connected to the insertion boss 69 and another end connected to a bottom wall of the spring accommodating portion 59.

Each insertion hole 60 is a hole elongated in the vertical direction. Each insertion hole 60 (right insertion hole 60) formed on the right and left side walls of the sheet supply tray 8 is formed so as to cutout the inner surface of the right and left side walls of the sheet supply tray 8 toward an outer surface thereof and positioned at a position overlapped with an upper portion of the corresponding spring accommodating portion 59 when projected in the rightward/leftward direction. In other words, each insertion hole 60 is formed to overlap with the upper portion of the spring accommodating portion 59 in the rightward/leftward direction. Further, each insertion hole 60 has a length in the frontward/rearward direction greater than a diameter of the insertion boss 69.

The right support member 62 is resiliently supported to the bottom walls of the three right spring accommodating portions 59 via the three right compression springs 58 by inserting the three right insertion bosses 69 into the corresponding right insertion holes 60. Likewise, the left support member 62 is resiliently supported to the bottom walls of the left spring accommodating sections 59 via the three left compression springs 58 by inserting the three left insertion bosses 69 into the corresponding left insertion holes 60. Hence, the pair of right and left support members 62 is resiliently supported to the sheet supply tray 8.

The sheet conveying member 61 is supported to the support members 62, by engaging the supported bosses 63 with the corresponding support recesses 68 formed in the support members 62. Hence, the sheet conveying member 61 is supported to the pair of right and left support members 62.

With this configuration, the sheet conveying member 61 is constantly urged upward by the urging force of the compression springs 58. Further, the sheet conveying member 61 is disposed below the process frame 81 and confronts the process frame 81 such that each second roller member 67 is in pressure contact with the corresponding first roller member 73 from below. A top surface of the sheet conveying member 61 is arranged in confrontation with and spaced apart from a bottom surface of the process frame 81.

When the sheet conveying member 61 is pressed downward, the sheet conveying member 61 moves downward against the urging force of the compression springs 58.

5. Second Conveying Path

Conveyance of the sheet P in a second conveying path will be described while referring to FIG. 1. The second conveying path corresponds to a conveying path extending from the manual insertion opening 75 to a position between the pickup roller 10 and the lift member 9 through the first conveying members 71 and the second conveying members 64.

The sheet P inserted into the manual insertion opening 75 (indicated by a broken-line shown in FIG. 1) is guided to a nip region defined between the foremost first conveying member 71 and the foremost second conveying member 64 (FIG. 4) by the manual insertion guide 47 of the front cover 7, the upper surface of the handle 57 of the sheet supply tray 8, and the front guide surface 76 of the sheet conveying member 61.

Then, the sheet P is conveyed rearward between the bottom surface of the process frame 81 and the top surface of the sheet conveying member 61 while each first conveying member 71 is driven to rotate and each second conveying member 64 follows rotation of the corresponding first conveying member 71.

Subsequently, the sheet P is guided to the position between the pickup roller 10 and the lift member 9 by the rear guide surface 77 disposed in the rear portion of the sheet conveying member 61.

That is, in the second conveying path, the sheet P inserted into the manual insertion opening 75 is conveyed to the position between the pickup roller 10 and the lift member 9, the position being located upstream of the position N in a sheet conveying direction of the first conveying path.

In other words, the second conveying path joins the first conveying path at the position between the pickup roller 10 and the lift member 9 that is positioned upstream of the position N in the sheet conveying direction.

The sheet P conveyed to the first conveying path from the second conveying path at the position between the pickup roller 10 and the lift member 9 is conveyed to a position between the sheet supply roller 11 and the sheet supply pad 12 by rotation of the pickup roller 10, as described above. Then, the sheet P is conveyed upward toward the registration rollers 14 so as to sequentially pass between the sheet supply roller 11 and each pinch roller 13 by rotation of the sheet supply roller 11. The sheet P is further conveyed to the position N at a prescribed timing by rotation of the registration rollers 14.

In other words, the first conveying path and the second conveying path share the pickup roller 10.

6. Removal and Mounting of Process Cartridge Relative to Main Casing

To remove the process cartridge 19 from the main casing 2 or to mount the process cartridge 19 in the main casing 2, as shown in FIG. 4, initially, the front cover 7 is moved to the open position from the closed position to open the opening 6. Next, the process unit 15 is pulled frontward from the main casing 2 through the opening 6.

Then, each rearmost roller 85 of the process unit 15 is separated from the corresponding leaf spring 53 at the rear portion of the corresponding first guide recess 52. Each front roller 84 of the process unit 15 is also separated from the corresponding leaf spring 55 at the rear portion of the corresponding second guide recess 54. Upon separation of the rollers 54 and 85 from the leaf springs 53 and 55, the process unit 15 is moved downward so that each photosensitive drum 20 is separated from the lower portion of the intermediate transfer belt 30.

At this time, the sheet conveying member 61 of the sheet supply tray 8 is moved downward in association with the downward movement of the process unit 15.

When the process unit 15 is further pulled frontward, the process unit 15 is guided by the first guide recesses 52 and the second guide recesses 54 while maintaining a slight space between the lower portion of the intermediate transfer belt 30 and the process unit 15. The process unit 15 is then pulled outward from the main casing 2.

Subsequently, the process cartridge 19 is removed from the pulled-out process unit 15. More specifically, to remove the process cartridge 19 mounted in the process unit 15 from the process unit 15, the process cartridge 19 is pulled upward. To mount the process cartridge 19 in the process unit 15, the process cartridge 19 is positioned above the process frame 81 so that the right and left ends of the rotation shaft 92 of the photosensitive drum 20 are respectively disposed above the right and left cartridge guide recesses 82. Then, the process cartridge 19 is inserted into the process frame 81 from above.

By performing, in reverse order, the above-described operation for removing the process unit 15 from the main casing 2, the process unit 15 is mounted in the main casing 2.

More specifically, the process unit 15 is inserted into the main casing 2 along the first guide recesses 52 and the second guide recesses 54.

At this time, the sheet conveying member 61 of the sheet supply tray 8 is pressed downward by the process unit 15 to be moved downward against the urging force of the compression springs 58. Further, the process unit 15 is guided by the first guide recesses 52 and the second guide recesses 54 to be inserted into the main casing 2, while maintaining a slight space between the lower portion of the intermediate transfer belt 30 and the process unit 15.

Then, each rearmost roller 85 of the process unit 15 ride up over the corresponding leaf spring 53 at the rear portion of the corresponding first guide recess 52. Each front roller 84 of the process unit 15 also rides up over the corresponding leaf spring 55 at the rear portion of the corresponding second guide recess 54. The process unit 15 is thus moved upward so that each photosensitive drum 20 is brought into contact with the lower portion of the intermediate transfer belt 30.

As a result, the process unit 15 is mounted in the main casing 2 so as to be constantly biased upward by the biasing forces of the leaf spring 53 and the leaf spring 55.

7. Paper Jam Fixing Process in Second Conveying Path

Figure 5:
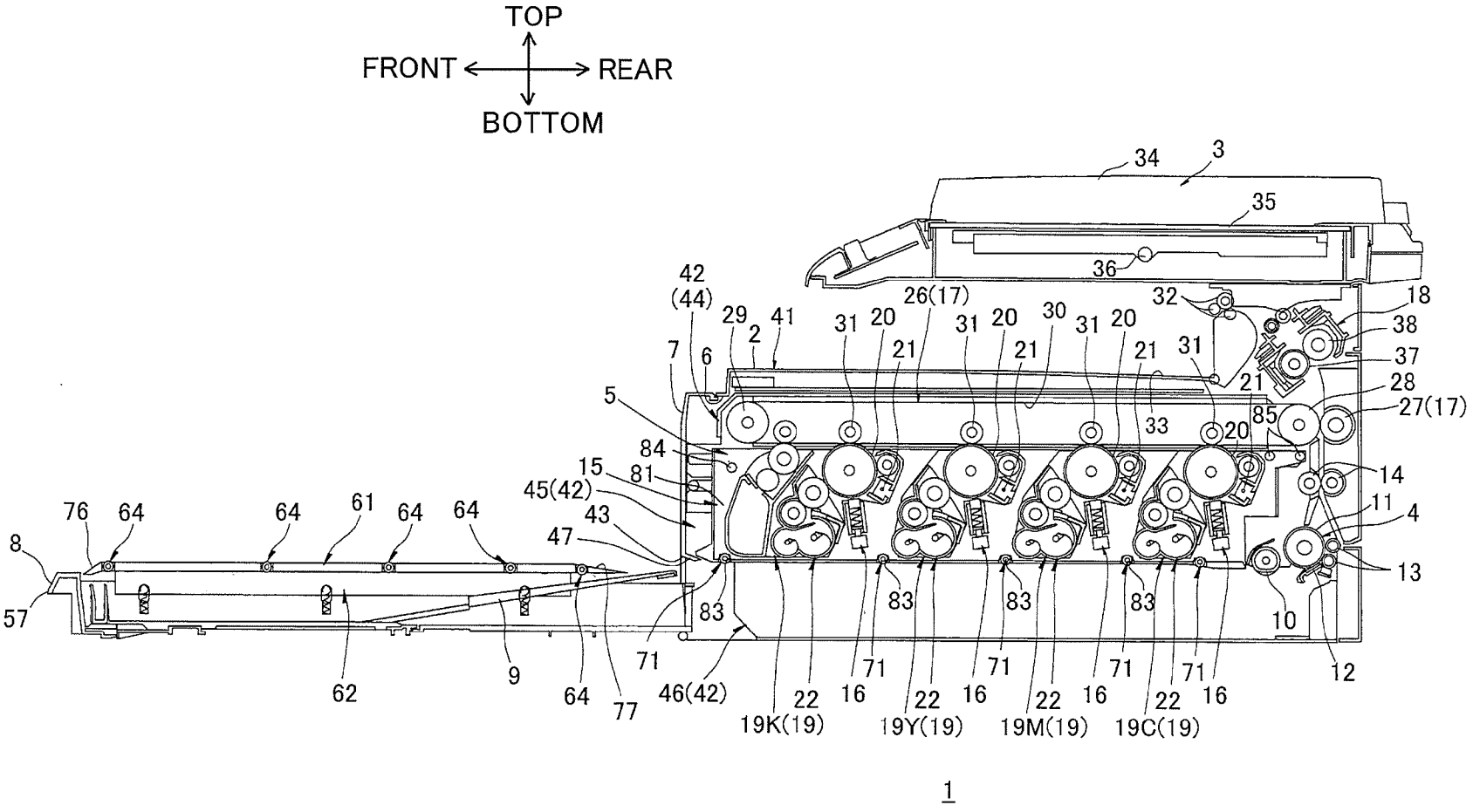
FIG. 5 is an explanatory view illustrating a paper jam process of a second conveying path in the color printer according to the first embodiment, in which the sheet supply tray has been pulled out.

When paper jam occurs while the sheet P is conveyed in the second conveying path, as shown in FIG. 5, the sheet supply tray 8 is pulled frontward so as to be removed from the main casing 2.

The jammed sheet P is pulled outward from the main casing 2 together with the pulled-out sheet supply tray 8 so as to be placed on the sheet conveying member 61. Alternatively, the jammed sheet P falls into the space defined below the process unit 15 by removing the sheet supply tray 8 from the main casing 2.

Then, the sheet P placed on the sheet conveying member 61 or the sheet P dropped into the space below the process unit 15 is collected to be removed.

As described above, the sheet P jammed in the second conveying path can be removed.

8. Operations and Effects (1) In the color printer 1 according to the first embodiment of the present invention, as shown in FIG. 1, the second conveying path is configured such that the sheet P inserted into the manual insertion opening 75 is convey to the first conveying path at the position between the pickup roller 10 and the lift member 9, the position being located upstream of the position N where the intermediate transfer belt 30 confronts the secondary transfer roller 27 in the sheet conveying direction of the first conveying path. Further, the process unit 15 is provided with the first conveying members 71 for conveying the sheet P fed through the manual insertion opening 75.

Accordingly, the second conveying path can be defined in combination with the process unit 15. Compared with a case where a second conveying path is formed independently of the process unit 15, the color printer 1 can be made more compact.

Consequently, the color printer 1 can be prevented from increasing in size, while the color printer 1 includes the second conveying path capable of accessible from the side where a user accesses to replace the process cartridge 19 or to supply the sheet P (i.e. front side).

Further, in the color printer 1 according to the first embodiment, the user can access the second conveying path from the side where the replacement of the process cartridge 19 and supply of the sheet P are performed (i.e. front side). Even if a space around the color printer 1, such as a space at a rear, left or right side of the color printer 1, is restricted, the user can easily access the second conveying path.

(2) Further, in the color printer 1 according to the first embodiment, as shown in FIGS. 1 and 3, the sheet supply tray 8 is provided with the second conveying members 64 that are arranged in confrontation with the corresponding first conveying members 71 and configured to convey the sheet P fed through the manual insertion opening 75 in conjunction with the first conveying members 71.

Hence, the sheet supply tray 8 and the process unit 15 can define the second conveying path therebetween. Accordingly, compared with a case where a second conveying path is formed independently of the sheet supply tray 8 or the process unit 15, the color printer 1 can be made more compact.

Further, removal of the sheet supply tray 8 from the main casing 2 allows the second conveying path to open in the vertical direction. Hence, the sheet P jammed in the second conveying path can be easily removed therefrom.

More specifically, the sheet P jammed in the second conveying path can be pulled outward from the main casing 2 together with the sheet supply tray 8. Alternatively, the sheet P jammed in the second conveying path can be dropped into the space defined below the process unit 15 by removing the sheet supply tray 8 from the main casing 2.

Further, the sheet P placed on the sheet conveying member 61 or the sheet P dropped into the space below the process unit 15 can be easily collected and removed.

(3) Further, in the color printer 1 according to the first embodiment, as shown in FIGS. 1 and 3, the second conveying members 64 are constantly biased upward by the compression springs 58. The second conveying members 64 are movable downward against the compression springs 58.

Hence, downward movement of the process unit 15 is permitted while the second conveying members 64 are in pressure contact with the first conveying members 71 from below. When the process unit 15 is removed from or mounted in the main casing 2, the process unit 15 is slidably movable while maintaining a gap between the process unit 15 and the intermediate transfer belt 30.

As a result, the process unit 15 can be smoothly removed from or mounted in the main casing 2, avoiding sliding contact between the photosensitive drums 20 and the intermediate transfer belt 30.

(4) Further, in the color printer 1 according to the first embodiment, as shown in FIG. 1, when the process unit 15 is in the mounted position, the pickup roller 10 is provided at a position overlapped with the process unit 15 when projected in the frontward/rearward direction. In other words, the pickup roller 10 is arranged to overlap with the process unit 15 in the frontward/rearward direction.

More specifically, the pickup roller 10 is disposed above the sheet supply tray 8 and also disposed rearward of the process unit 15. Hence, the process unit 15 and the sheet supply tray 8 are arranged to be close to each other in the vertical direction. Accordingly, the color printer 1 can be made flatter, that is, can be downsized in the vertical direction.

(5) Further, in the color printer 1 according to the first embodiment, as shown in FIG. 1, the first conveying path and the second conveying path share the pickup roller 10. Hence, it is not necessary to provide two pickup rollers 10 for the first conveying path and the second conveying path. Accordingly, the number of parts and components of the color printer 1 can be reduced.

(6) Further, in the color printer 1 according to the first embodiment, as shown in FIG. 1, each of the intermediate three first conveying members 71 is disposed between each process cartridge 19 (i.e. each photosensitive drum 20).

Hence, the intermediate three first conveying member 71 can be efficiently allocated by utilizing each space defined between each process cartridge 19. As a result, the color printer 1 can be made more compact.

(7) Further, in the color printer 1 according to the first embodiment, as shown in FIG. 1, the process unit 15 includes the LED units 16 for exposing the corresponding photosensitive drums 20.

Hence, compared with a case where a member for exposing the photosensitive drum 20 is provided independently of the process unit 15, the color printer 1 can be made more compact.

(8) Further, in the color printer 1 according to the first embodiment, as shown in FIG. 1, the process unit 15 includes a belt cleaning unit 93 disposed in contact with the intermediate transfer belt 30 and adapted to clean the intermediate transfer belt 30.

Hence, compared with a case where a member for cleaning the intermediate transfer belt 30 is provided independently of the process unit 15, the color printer 1 can be made more compact.

9. Second Embodiment

A color printer 101 as an image forming device according to a second embodiment of the present invention will be described while referring to FIGS. 6 to 8. In the following description, only parts differing from those of the above-described embodiment will be described.

In the above described first embodiment, the sheet conveying member 61 is provided in the sheet supply tray 8. However, in the second embodiment, as shown in FIG. 6, a sheet conveying member 161 is provided at a bottom section of a process unit 115. Note that parts and components appearing in the second embodiment and the same as those in the first embodiment will be designated by the same reference numerals as those in the first embodiment to avoid duplicating description.

Figure 7:
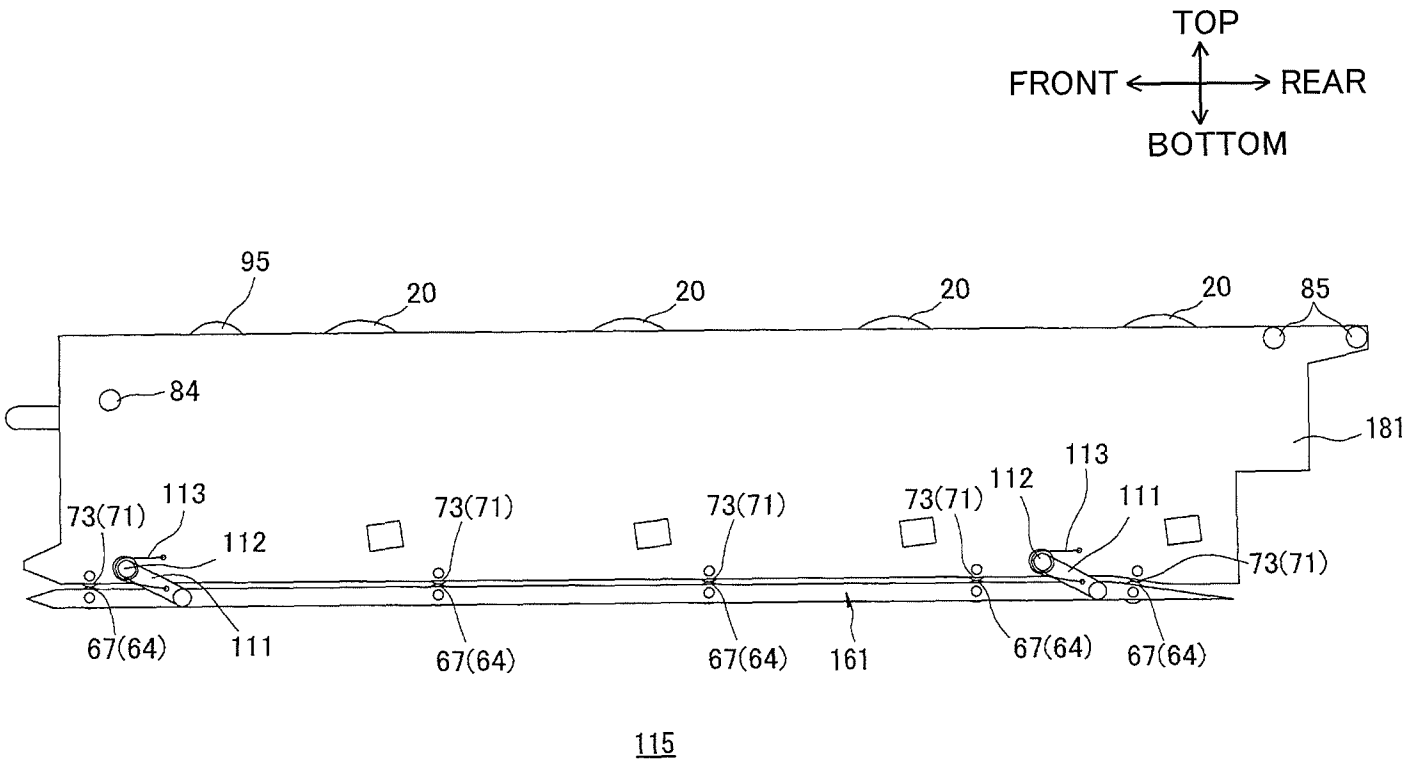
FIG. 7 is a side view of the process unit shown in FIG. 6.

As shown in FIG. 7, the process unit 115 includes a process frame 181 retaining each process cartridge 19 and the sheet conveying member 161.

The sheet conveying member 161 has right and left side surfaces whose front and rear portions are connected to the process frame 181 by connection arms 111. That is, the front and rear portions of the right side surface of the sheet conveying member 161 are connected to a right side wall of the process frame 181 by the two right connection arms 111, and the front and rear portions of the left side surface of the sheet conveying member 161 are connected to a left side wall of the process frame 181 by the two left connection arms 111.

Each connection arm 111 is formed in a generally lever-shape, having one end pivotally movably supported to a lower portion of the corresponding side wall of the process frame 181 and another end pivotally movably supported to the side surface of the sheet conveying member 161.

Further, each connection arm 111 is constantly biased in a counterclockwise direction in FIG. 7 by a coil spring 113 wound around a pivot shaft 112 provided at the one end of the connection arm 111. The coil spring 113 has one end fixed to the side wall of the process frame 181 and another end fixed to the right connection arm 111. That is, each connection arm 11 is urged by the coil spring 113 such that another end of the connection arm 11 comes close to the process frame 81.

With this configuration, the sheet conveying member 61 is biased in the counterclockwise direction in FIG. 7 by the connection arms 111. Further, the sheet conveying member 61 is movable between a sheet conveying position (FIG. 7) and a jam processing position (FIG. 8). When the sheet conveying member 61 is positioned at the sheet conveying position (FIG. 7), the sheet conveying member 61 is disposed below the process frame 81 and confronts the process frame 81 such that each second roller member 67 is in pressure contact with the corresponding first roller member 73 from below. At this time, each connection arm 111 extends diagonally below and rearward from the one end.

Further, the sheet conveying member 161 is positioned at the jam processing position, the sheet conveying member 161 is disposed below and spaced apart from the process frame 81 by being pulled diagonally below and forward against the biasing force of the connection arms 111. At this time, each connection arm 111 extends downward.

Figure 6:
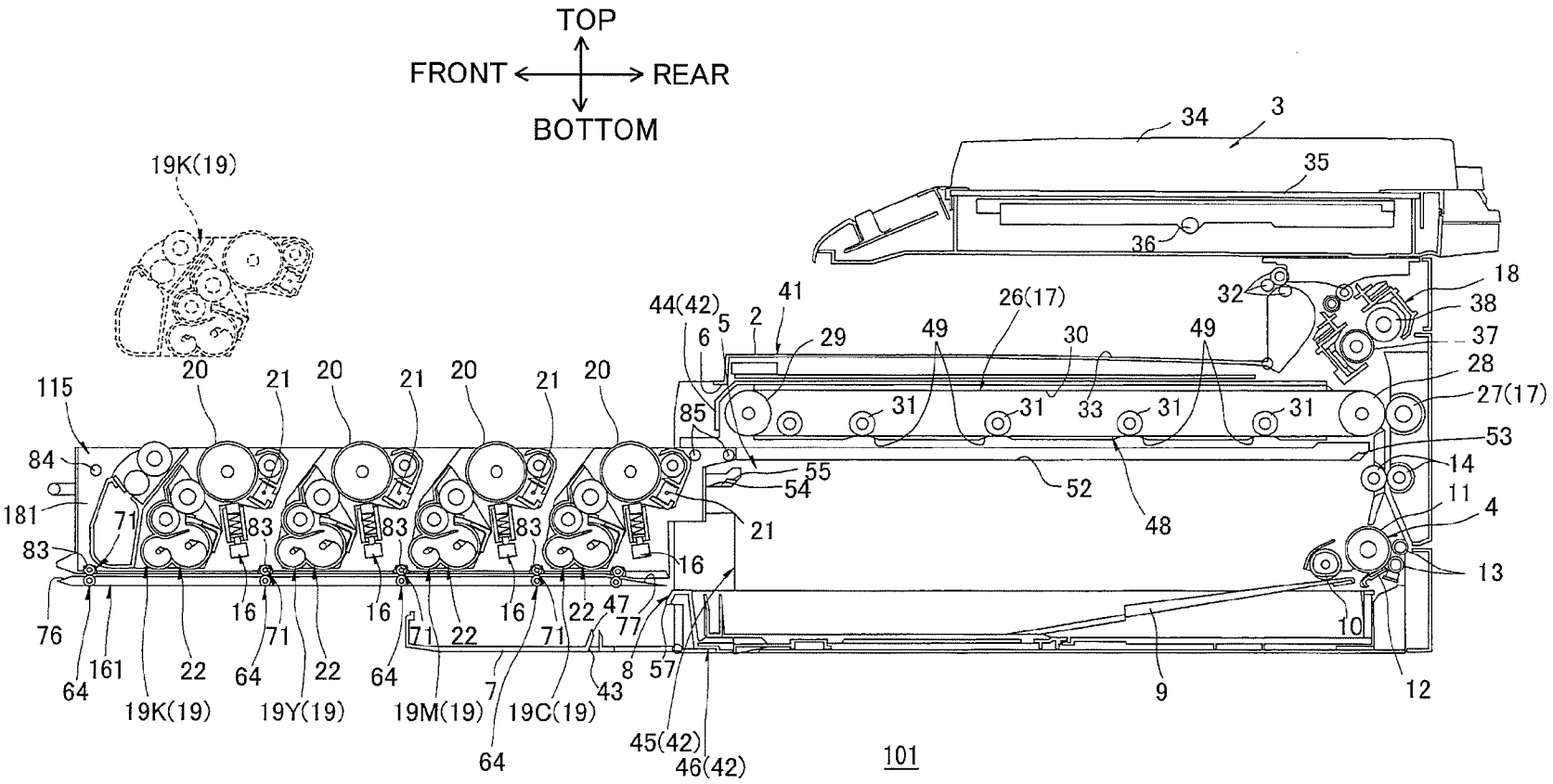
FIG. 6 is an explanatory view illustrating a paper jam process of a second conveying path in a color printer according to a second embodiment of the present invention, in which a process unit has been pulled out.

In the second embodiment, when the sheet P is jammed in the second conveying path, the process unit 115 is initially pulled frontward from the main casing 2 as shown in FIG. 6.

Figure 8:
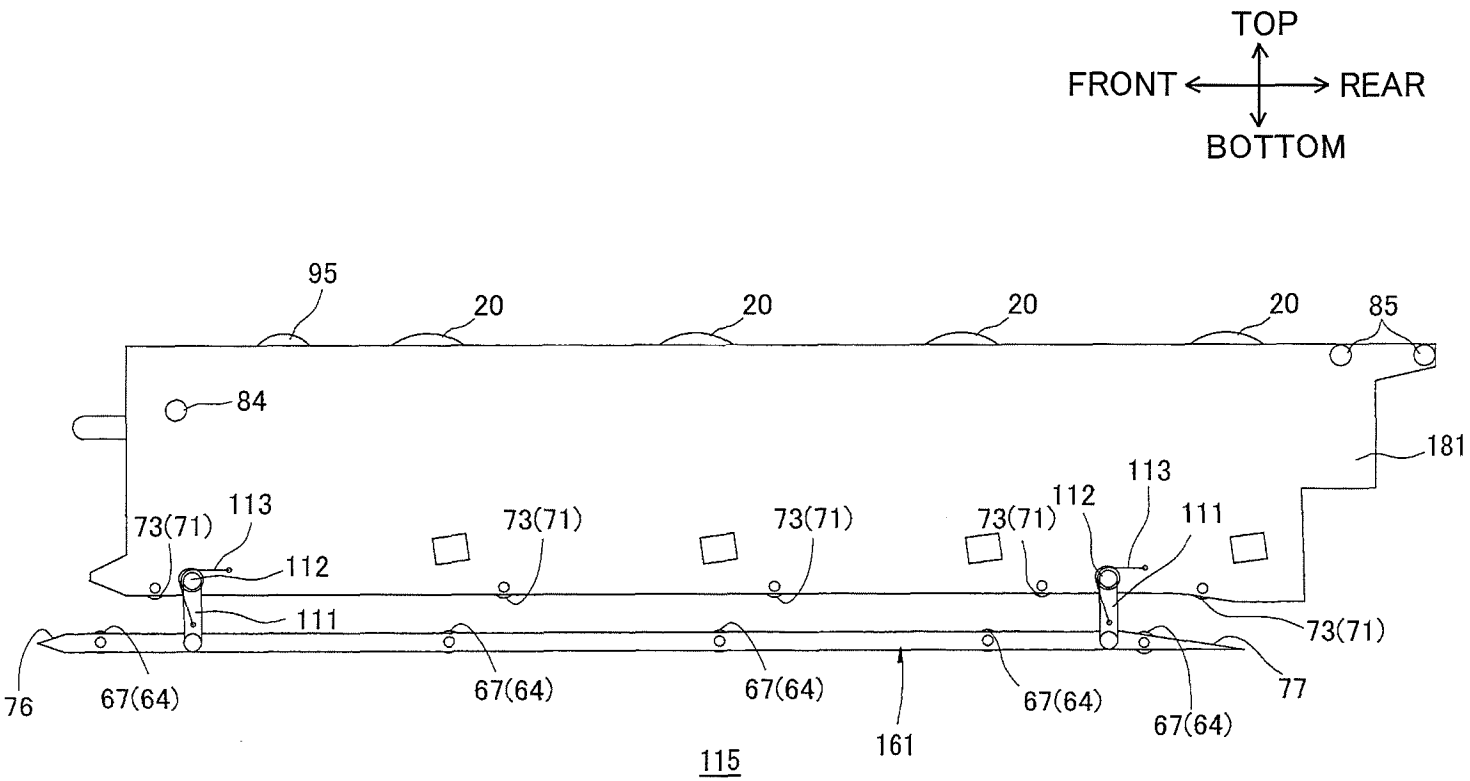
FIG. 8 is an explanatory view illustrating the paper jam process of the second conveying path in the color printer according to the second embodiment, in which a sheet conveying member has been separated from a process frame.

Then, as shown in FIG. 8, the sheet conveying member 161 is pulled diagonally below and frontward to separate the sheet conveying member 161 from the process frame 181. Then, the sheet P jammed between the sheet conveying member 161 and the process frame 181 is collected to be removed.

As described above, the sheet P jammed in the second conveying path can be removed.

In the color printer 101 according to the second embodiment, as shown in FIG. 8, the process unit 115 is provided with the second conveying members 64 capable of separating (moving downward) from the corresponding first conveying members 71.

Accordingly, the second conveying path can be formed in the process unit 115. Hence, compared with a case where a second conveying path is formed independently of the process unit 115, the color printer 101 can be made more compact.

Further, the sheet P jammed in the second conveying path can be easily removed, by removing the process unit 115 from the main casing 2 to move the second conveying members 64 downward for separating from the corresponding first conveying members 71.

Further, in the color printer 101 according to the second embodiment, the same operations and effects of the first embodiment can be obtained. While the present invention has been described in detail with reference to the present embodiments thereof, it would be apparent to those skilled in the art that various changes and modifications may be made therein without departing from the spirit of the present invention.

What is claimed is:

1. An image forming apparatus comprising:

a main casing;

a sheet supply tray configured to feed a sheet and movable in a moving direction from an outer position in which the sheet supply tray is outside the main casing to an inner position in which the sheet supply tray is inside the main casing;

a photosensitive drum;

an LED unit configured to expose the photosensitive drum to light and disposed between the photosensitive drum and the sheet supply tray in a vertical direction;

a belt unit including a first roller, a second roller, and an intermediate transfer belt stretched around the first roller and the second roller, the intermediate transfer belt being disposed confronting the photosensitive drum from above and contacting the photosensitive drum;

a primary transfer roller disposed such that the intermediate transfer belt is interposed between the primary transfer roller and the photosensitive drum;

a secondary transfer roller disposed such that the intermediate transfer belt is interposed between the first roller and the secondary transfer roller;

a first conveying roller disposed between the LED unit and the sheet supply tray in the vertical direction;

a second conveying roller configured to convey a sheet from the first conveying roller to the secondary transfer roller, the second conveying roller being disposed between the LED unit and the sheet supply tray in the vertical direction and downstream from the first conveying roller in a direction the same as the moving direction; and a tray disposed between the LED unit and the sheet supply tray in the vertical direction, the tray being movable in a direction the same as the moving direction from an outer position in which the tray is outside the main casing to an inner position in which the tray is inside the main casing, the tray including a first follower roller and a second follower roller, the first follower roller being located below the first conveying roller when the tray is at the inner position, the second follower roller being located below the second conveying roller when the tray is at the inner position, the first conveying roller and the second conveying roller being configured to receive a driving force so as to convey a sheet with the first follower roller and the second follower roller toward the second transfer roller, and the first conveying roller and the second conveying roller being positioned inside the main casing when the tray is located at the outer position.

2. The image forming apparatus according to claim 1, wherein the LED unit includes an LED array supporting part and an LED array supported to the LED array supporting part, wherein the LED array supporting part includes a support beam, and wherein the support beam is in a quadrangular prism shape extending in a direction parallel to an axial direction of the photosensitive drum.

3. The image forming apparatus according to claim 2, wherein the LED array supporting part further includes an LED array accommodating part, in which the LED array is accommodated, and wherein the LED array accommodating part has an internal dimension greater than an external dimension of the LED array.

4. The image forming apparatus according to claim 2, wherein the LED array has a length in a direction parallel to an axial direction of the photosensitive drum that is smaller than a length of the photosensitive drum in the axial direction of the photosensitive drum.

5. The image forming apparatus according to claim 2, wherein the LED array is provided with an LED positioning member configured to contact the photosensitive drum from below, thereby positioning the LED array relative to the photosensitive drum.

6. The image forming apparatus according to claim 1, further comprising a retaining unit retaining the photosensitive drum, the retaining unit movable between a mounted position, in which the retaining unit is mounted in the main casing, and a pulled-out position, in which the retaining unit is pulled out of the main casing, in a direction parallel to the moving direction.

7. The image forming apparatus according to claim 1, wherein the tray is configured to move together with the sheet supply tray.

* * * * *